US006933061B2

(12) United States Patent
Nagaraj et al.

(10) Patent No.: US 6,933,061 B2
(45) Date of Patent: Aug. 23, 2005

(54) THERMAL BARRIER COATING PROTECTED BY THERMALLY GLAZED LAYER AND METHOD FOR PREPARING SAME

(75) Inventors: Bangalore Aswatha Nagaraj, West Chester, OH (US); Brett Allen Boutwell, Liberty Township, OH (US); Todd Jay Rockstroh, Maineville, OH (US); Wilbur Douglas Scheidt, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/317,730

(22) Filed: Dec. 12, 2002

(65) Prior Publication Data

US 2004/0115406 A1 Jun. 17, 2004

(51) Int. Cl.[7] ..... B32B 15/04; C03C 16/00; B05D 3/00; F03B 3/12

(52) U.S. Cl. ..... 428/633; 428/632; 428/332; 428/697; 428/701; 428/702; 427/556; 427/376.2; 427/376.4; 416/241 B

(58) Field of Search ..... 428/469, 332, 428/336, 621, 632, 633, 679, 680, 650, 699, 701, 702, 697; 427/556, 376.2, 376.4; 416/241 B

(56) References Cited

U.S. PATENT DOCUMENTS

| | | | |
|---|---|---|---|
| 4,116,723 | A | 9/1978 | Gell et al. |
| 4,377,371 | A | 3/1983 | Wisander et al. |
| 4,422,648 | A | 12/1983 | Eaton et al. |
| 4,675,204 | A | 6/1987 | Nicoll et al. |
| 4,741,286 | A | 5/1988 | Itoh et al. |

(Continued)

FOREIGN PATENT DOCUMENTS

| | | |
|---|---|---|
| EP | 1 088 908 A2 | 4/2001 |
| EP | 1 335 040 A2 | 8/2003 |

OTHER PUBLICATIONS

Tsai et al, "Microstructures and Properties of Laser–Glazed Plasma Sprayed ZrO2–YO1.5/Ni–22Cr–10Al–1Y Thermal Barrier Coatings," Journal of Materials Engineering And Performance, (1995) 4(6) 86–87, pp 689–696.

U.S. Appl. No. 10/317,732, filed Dec. 12, 2002, Bangalore Aswatha Nagaraj et al.

(Continued)

*Primary Examiner*—Jennifer McNeil
(74) *Attorney, Agent, or Firm*—Eric W. Guttag; Jagtiani + Guttag; David L. Narciso

(57) ABSTRACT

A thermal barrier coating for an underlying metal substrate of articles that operate at, or are exposed to, high temperatures, as well as being exposed to environmental contaminant compositions. This coating comprises an inner layer nearest to the underlying metal substrate comprising a ceramic thermal barrier coating material having a melting point of at least about 2000° F. (1093° C.), as well as a thermally glazed outer layer having an exposed surface and a thickness up to 0.4 mils (about 10 microns) and sufficient to at least partially protect the thermal barrier coating against environmental contaminants that become deposited on the exposed surface, and comprising a thermally glazeable coating material having a melting point of at least about 2000° F. (1093° C.) in an amount up to 100%. This coating can be used to provide a thermally protected article having a metal substrate and optionally a bond coated layer adjacent to and overlaying the metal substrate. The thermal barrier coating can be prepared by forming the inner layer comprising the ceramic thermal barrier coating material, followed by depositing the thermally glazeable coating material on the inner layer, and then thermally melting the thermally glazeable coating material to form the thermally glazed outer layer.

14 Claims, 1 Drawing Sheet

U.S. PATENT DOCUMENTS

| | | | |
|---|---|---|---|
| 4,988,538 | A | 1/1991 | Horvei et al. |
| 5,015,502 | A | 5/1991 | Strangman et al. |
| 5,047,612 | A | 9/1991 | Savkar et al. |
| 5,059,095 | A | * 10/1991 | Kushner et al. |
| 5,332,598 | A | 7/1994 | Kawasaki et al. |
| 5,399,313 | A | 3/1995 | Ross et al. |
| 5,465,780 | A | 11/1995 | Muntner et al. |
| 5,484,980 | A | 1/1996 | Pratt et al. |
| 5,576,069 | A | 11/1996 | Chen et al. |
| 5,660,885 | A | 8/1997 | Hasz et al. |
| 5,683,825 | A | 11/1997 | Bruce et al. |
| 5,780,110 | A | 7/1998 | Schaeffer et al. |
| 6,025,078 | A | 2/2000 | Rickerby et al. |
| 6,103,315 | A | 8/2000 | Gray et al. |
| 6,117,560 | A | 9/2000 | Maloney |
| 6,177,200 | B1 | 1/2001 | Maloney |
| 6,180,260 | B1 | 1/2001 | Gray et al. |
| 6,210,812 | B1 | 4/2001 | Hasz et al. |
| 6,284,323 | B1 | 9/2001 | Maloney |
| 6,294,261 | B1 | 9/2001 | Snageeta et al. |
| 6,319,614 | B1 | 11/2001 | Beele |
| 6,333,118 | B1 | 12/2001 | Alperine et al. |
| 6,335,105 | B1 | 1/2002 | McKee |
| 6,355,086 | B2 | 3/2002 | Brown et al. |
| 6,387,527 | B1 | 5/2002 | Hasz et al. |
| 2003/0152797 | A1 | 8/2003 | Darolia |

OTHER PUBLICATIONS

U.S. Appl. No. 10/317,759, filed Dec. 12, 2002, Bangalore Aswatha Nagaraj et al.

U.S. Appl. No. 10/317,731, filed Dec. 12, 2002, Bangalore Aswatha Nagaraj et al.

U.S. Appl. No. 10/317,758, filed Dec. 12, 2002, John Frederick Ackerman et al.

* cited by examiner

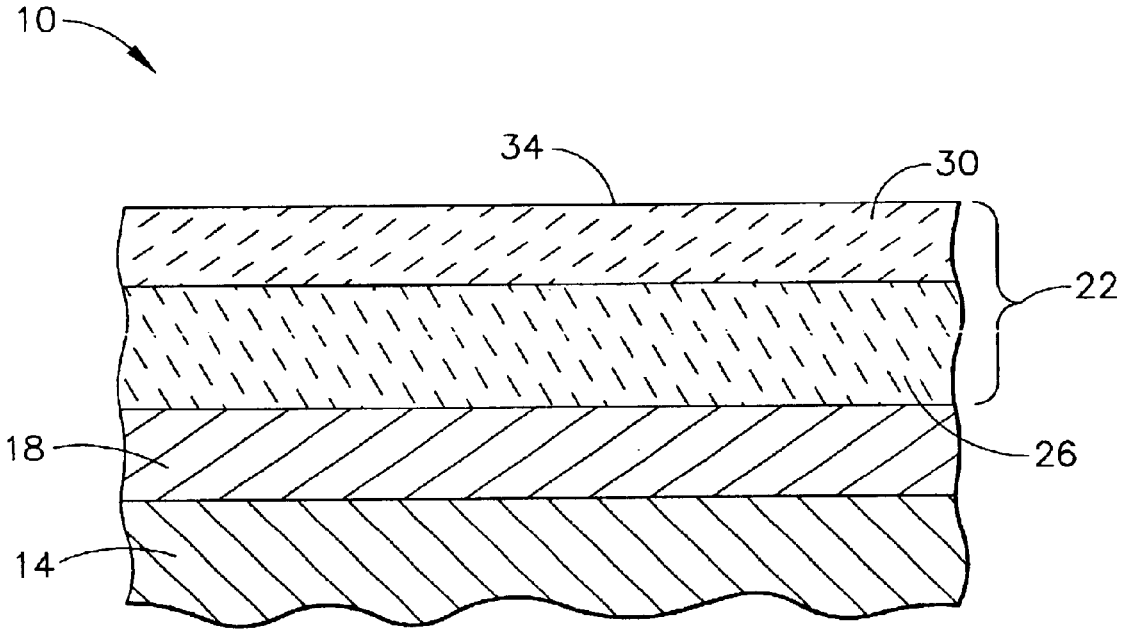
10
34
30
22
18
26
14

THERMAL BARRIER COATING PROTECTED BY THERMALLY GLAZED LAYER AND METHOD FOR PREPARING SAME

STATEMENT REGARDING FEDERALLY SPONSORED RESEARCH

This invention was made with Government support under Contract No. N00019-96-C-0176 awarded by the Department of the Navy. The Government has certain rights to the invention.

BACKGROUND OF THE INVENTION

The present invention relates to thermal barrier coatings having a relatively thin thermally glazed surface layer for protection and mitigation against environmental contaminants, in particular oxides of calcium, magnesium, aluminum, silicon, and mixtures thereof that can become deposited onto such coatings. The present invention further relates to articles with thermal barrier coatings having such glazed surface layers and a method for preparing such coatings for the article.

Thermal barrier coatings are an important element in current and future gas turbine engine designs, as well as other articles that are expected to operate at or be exposed to high temperatures, and thus cause the thermal barrier coating to be subjected to high surface temperatures. Examples of turbine engine parts and components for which such thermal barrier coatings are desirable include turbine blades and vanes, turbine shrouds, buckets, nozzles, combustion liners and deflectors, and the like. These thermal barrier coatings are deposited onto a metal substrate (or more typically onto a bond coat layer on the metal substrate for better adherence) from which the part or component is formed to reduce heat flow and to limit the operating temperature these parts and components are subjected to. This metal substrate typically comprises a metal alloy such as a nickel, cobalt, and/or iron based alloy (e.g., a high temperature superalloy).

The thermal barrier coating usually comprises a ceramic material, such as a chemically (metal oxide) stabilized zirconia. Examples of such chemically stabilized zirconias include yttria-stabilized zirconia, scandia-stabilized zirconia, calcia-stabilized zirconia, and magnesia-stabilized zirconia. The thermal barrier coating of choice is typically a yttria-stabilized zirconia ceramic coating. A representative yttria-stabilized zirconia thermal barrier coating usually comprises about 7% yttria and about 93% zirconia. The thickness of the thermal barrier coating depends upon the metal substrate part or component it is deposited on, but is usually in the range of from about 3 to about 70 mils (from about 75 to about 1795 microns) thick for high temperature gas turbine engine parts.

Under normal conditions of operation, thermal barrier coated metal substrate turbine engine parts and components can be susceptible to various types of damage, including erosion, oxidation, and attack from environmental contaminants. At the higher temperatures of engine operation, these environmental contaminants can adhere to the heated or hot thermal barrier coating surface and thus cause damage to the thermal barrier coating. For example, these environmental contaminants can form compositions that are liquid or molten at the higher temperatures that gas turbine engines operate at. These molten contaminant compositions can dissolve the thermal barrier coating, or can infiltrate its porous structure, i.e., can infiltrate the pores, channels or other cavities in the coating. Upon cooling, the infiltrated contaminants solidify and reduce the coating strain tolerance, thus initiating and propagating cracks that cause delamination, spalling and loss of the thermal barrier coating material either in whole or in part.

These pores, channel or other cavities that are infiltrated by such molten environmental contaminants can be created by environmental damage, or even the normal wear and tear that results during the operation of the engine. However, this porous structure of pores, channels or other cavities in the thermal barrier coating surface more typically is the result of the processes by which the thermal barrier coating is deposited onto the underlying bond coat layer-metal substrate. For example, thermal barrier coatings that are deposited by (air) plasma spray techniques tend to create a sponge-like porous structure of open pores in at least the surface of the coating. By contrast, thermal barrier coatings that are deposited by physical (e.g., chemical) vapor deposition techniques tend to create a porous structure comprising a series of columnar grooves, crevices or channels in at least the surface of the coating. This porous structure can be important in the ability of these thermal barrier coating to tolerate strains occurring during thermal cycling and to reduce stresses due to the differences between the coefficient of thermal expansion (CTE) of the coating and the CTE of the underlying bond coat layer/substrate.

For turbine engine parts and components having outer thermal barrier coatings with such porous surface structures, environmental contaminant compositions of particular concern are those containing oxides of calcium, magnesium, aluminum, silicon, and mixtures thereof. See, for example, U.S. Pat. No. 5,660,885 (Hasz et al), issued Aug. 26, 1997 which describes these particular types of oxide environmental contaminant compositions. These oxides combine to form contaminant compositions comprising mixed calcium-magnesium-aluminum-siliconoxide systems (Ca—Mg—Al—SiO), hereafter referred to as "CMAS." During normal engine operations, CMAS can become deposited on the thermal barrier coating surface, and can become liquid or molten at the higher temperatures of normal engine operation. Damage to the thermal barrier coating typically occurs when the molten CMAS infiltrates the porous surface structure of the thermal barrier coating. After infiltration and upon cooling, the molten CMAS solidifies within the porous structure. This solidified CMAS causes stresses to build within the thermal barrier coating, leading to partial or complete delamination and spalling of the coating material, and thus partial or complete loss of the thermal protection provided to the underlying metal substrate of the part or component.

Accordingly, it would be desirable to protect these thermal barrier coatings having a porous surface structure against the adverse effects of such environmental contaminants when used with a metal substrate for a turbine engine part or component, or other article, operated at or exposed to high temperatures. In particular, it would be desirable to be able to protect such thermal barrier coatings from the adverse effects of deposited CMAS.

BRIEF DESCRIPTION OF THE INVENTION

The present invention relates to a thermal barrier coating for an underlying metal substrate of articles that operate at, or are exposed, to high temperatures, as well as being exposed to environmental contaminant compositions, in particular CMAS. This thermal barrier coating comprises:

a. an inner layer nearest to and overlaying the metal substrate and comprising ceramic thermal barrier coating material having a melting point of at least about 2000° F. (1093° C.) in an amount up to 100%; and b. a thermally glazed outer layer adjacent to and overlaying the inner layer and having an exposed surface, the outer layer having a thickness up to about 0.4 mils (10 microns) and sufficient to at least partially protect the thermal barrier coating against environmental contaminants that become deposited on the exposed surface, and comprising a thermally glazeable coating material having a melting point of at least about 2000° F. (1093° C.) in an amount up to 100%.

The present invention also relates to a thermally protected article. This protected articles comprises:

a. a metal substrate;

b. optionally a bond coat layer adjacent to and overlaying the metal substrate; and c. a thermal barrier coating as previously describe adjacent to and overlaying the bond coat layer (or overlaying the metal substrate if the bond coat layer is absent).

The present invention further relates to a method for preparing the thermal barrier coating. This method comprises the steps of:

1. forming an inner layer overlaying the metal substrate, the inner layer comprising a ceramic thermal barrier coating material having a melting point of at least about 2000° F. (1093° C.) in an amount up to 100%;

2. depositing on the inner layer a thermally glazeable coating material having a melting point of at least about 2000° F. (1093° C.); and 3. thermally melting the deposited thermally glazeable coating material so as to form a thermally glazed outer layer adjacent to and overlaying the inner layer and having an exposed surface, the thermally glazed outer layer having a thickness up to about 0.4 mils (10) microns and sufficient to at least partially protect the thermal barrier coating against environmental contaminants that become deposited on the exposed surface.

The thermal barrier coating of the present invention is provided with at least partial and up to complete protection and mitigation against the adverse effects of environmental contaminant compositions that can become deposited on the surface of such coatings during normal turbine engine operation. In particular, the thermal barrier coating of the present invention is provided with at least partial and up to complete protection or mitigation against the adverse effects of CMAS deposits on such coating surfaces. The relatively thin thermally glazed outer exposed layer of the thermal barrier coating usually reduces the build up of these CMAS deposits on the coating, as well as preventing these CMAS deposits from infiltrating the porous surface structure of the thermal barrier coating. As a result, these CMAS deposits are unable to cause undesired partial (or complete) delamination and spalling of the coating. Because the thermally glazed outer exposed layer is relatively thin, i.e., up to about 0.4 mils (10 microns) in thickness, the mechanical properties (e.g., strain tolerance, modulus and thermal conductivity) of the thermal barrier coating are, at most, minimally affected.

In addition, the thermal barrier coatings of the present invention are provided with protection or mitigation, in whole or in part, against the infiltration of corrosive (e.g., alkali) environmental contaminant deposits. The thermal barrier coatings of the present invention are also useful with worn or damaged coated (or uncoated) metal substrates of turbine engine parts and components so as to provide for these refurbished parts and components protection and mitigation against the adverse effects of such environmental contaminate compositions, e.g., to provide refurbished parts and components. In addition to turbine engine parts and components, the thermal barrier coatings of the present invention are useful for metal substrates of other articles that operate at, or are exposed, to high temperatures, as well as to such environmental contaminate compositions.

BRIEF DESCRIPTION OF THE DRAWINGS

The FIGURE is a side sectional view of an embodiment of the thermal barrier coating and coated article of the present invention.

DETAILED DESCRIPTION OF THE INVENTION

As used herein, the term "CMAS" refers environmental contaminant compositions that contain oxides of calcium, magnesium, aluminum, silicon, and mixtures thereof. These oxides typically combine to form compositions comprising calcium-magnesium-aluminum-silicon-oxide systems (Ca—Mg—Al—SiO).

As used herein, the term "ceramic thermal barrier coating materials" refers to those coating materials that are capable of reducing heat flow to the underlying metal substrate of the article, i.e., forming a thermal barrier and which having a melting point of at least about 2000° F. (1093° C.), typically at least about 2200° F. (1204° C.), and more typically in the range of from about 2200° to about 3500° F. (from about 1204° to about 1927° C.). Suitable ceramic thermal barrier coating materials for use herein include, aluminum oxide (alumina), i.e., those compounds and compositions comprising $Al_2O_3$, including unhydrated and hydrated forms, various zirconias, in particular chemically stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias as well as mixtures of such stabilized zirconias. See, for example, Kirk-Othmer's Encyclopedia of Chemical Technology, 3rd Ed., Vol. 24, pp. 882–883 (1984) for a description of suitable zirconias. Suitable yttria-stabilized zirconias can comprise from about 1 to about 20% yttria (based on the combined weight of yttria and zirconia), and more typically from about 3 to about 10% yttria. These chemically stabilized zirconias can further include one or more of a second metal (e.g., a lanthanide or actinide) oxide such as dysprosia, erbia, europia, gadolinia, neodymia, praseodymia, urania, and hafnia to further reduce thermal conductivity of the thermal barrier coating. See U.S. Pat. No. 6,025,078 (Rickersby et al), issued Feb. 15, 2000 and U.S. Pat. No. 6,333,118 (Alperine et al), issued Dec. 21, 2001, both of which are incorporated by reference. Suitable non-alumina ceramic thermal barrier coating materials also include pyrochlores of general formula $A_2B_2O_7$ where A is a metal having a valence of 3+ or 2+ (e.g., gadolinium, aluminum, cerium, lanthanum or yttrium) and B is a metal having a valence of 4+ or 5+ (e.g., hafnium, titanium, cerium or zirconium) where the sum of the A and B valences is 7. Representative materials of this type include gadolinium-zirconate, lanthanum titanate, lanthanum zirconate, yttrium zirconate, lanthanum hafnate, cerium zirconate, aluminum cerate, cerium hafnate, aluminum hafnate and lanthanum cerate. See U.S. Pat. No. 6,117,560 (Maloney), issued Sep. 12, 2000; U.S. Pat. No. 6,177,200 (Maloney), issued Jan. 23, 2001; U.S. Pat. No. 6,284,323 (Maloney), issued Sep. 4, 2001; U.S. Pat. No. 6,319,614 (Beele), issued Nov. 20, 2001; and U.S. Pat. No.

6,87,526 (Beele), issued May 14, 2002, all of which are incorporated by reference.

As used herein, the term "thermally glazeable coating materials" refers to those coating materials that can be thermally melted and, on subsequent cooling, form a hermetic, glassy layer. Suitable thermally glazeable coating materials for use herein having a melting point of at least about 2000° F. (1093° C.), typically at least about 2200° F. (1204° C.), and more typically in the range of from about 2200° to about 3500° F. (from about 1204° to about 1927° C.), and can include any of the previously described ceramic thermal barrier coating materials. A particularly suitable thermally glazeable material comprises a mixture, blend or other combination of from about 50 to about 95% (more typically from about 80 to about 90%) of a chemically-stabilized zirconia, and from about 5 to about 50% (more typically from about 10 to about 20%) alumina.

As used herein, the term "comprising" means various compositions, compounds, components, layers, steps and the like can be conjointly employed in the present invention. Accordingly, the term "comprising" encompasses the more restrictive terms "consisting essentially of" and "consisting of."

All amounts, parts, ratios and percentages used herein are by weight unless otherwise specified.

The thermal barrier coatings of the present invention are useful with a wide variety of turbine engine (e.g., gas turbine engine) parts and components that are formed from metal substrates comprising a variety of metals and metal alloys, including superalloys, and are operated at, or exposed to, high temperatures, especially higher temperatures that occur during normal engine operation. These turbine engine parts and components can include turbine airfoils such as blades and vanes, turbine shrouds, turbine nozzles, combustor components such as liners and deflectors, augmentor hardware of gas turbine engines and the like. The thermal barrier coatings of the present invention can also cover a portion or all of the metal substrate. For example, with regard to airfoils such as blades, the thermal barrier coatings of the present invention are typically used to protect, cover or overlay portions of the metal substrate of the airfoil other than solely the tip thereof, e.g., the thermal barrier coatings cover the leading and trailing edges and other surfaces of the airfoil. While the following discussion of the thermal barrier coatings of the present invention will be with reference to metal substrates of turbine engine parts and components, it should also be understood that the thermal barrier coatings of the present invention are useful with metal substrates of other articles that operate at, or are exposed to, high temperatures, as well as being exposed to environmental contaminant compositions, including those the same or similar to CMAS.

The various embodiments of the thermal barrier coatings of the present invention are further illustrated by reference to the drawings as described hereafter. Referring to the drawings, the FIGURE shows a side sectional view of an embodiment of the thermally barrier coating of the present invention used with the metal substrate of an article indicated generally as 10. As shown in the FIGURE, article 10 has a metal substrate indicated generally as 14. Substrate 14 can comprise any of a variety of metals, or more typically metal alloys, that are typically protected by thermal barrier coatings, including those based on nickel, cobalt and/or iron alloys. For example, substrate 14 can comprise a high temperature, heat-resistant alloy, e.g., a superalloy. Such high temperature alloys are disclosed in various references, such as U.S. Pat. No. 5,399,313 (Ross et al), issued Mar. 21, 1995 and U.S. Pat. No. 4,116,723 (Gell et al), issued Sep. 26, 1978, both of which are incorporated by reference. High temperature alloys are also generally described in Kirk-Othmer's Encyclopedia of Chemical Technology, 3rd Ed., Vol. 12, pp. 417–479 (1980), and Vol. 15, pp. 787–800 (1981). Illustrative high temperature nickel-based alloys are designated by the trade names Inconel®, Nimonic®, Rene® (e.g., Rene® 80-, Rene® 95 alloys), and Udimet®. As described above, the type of substrate 14 can vary widely, but it is representatively in the form of a turbine part or component, such as an airfoil (e.g., blade) or turbine shroud.

As shown in the FIGURE, article 10 also includes a bond coat layer indicated generally as 18 that is adjacent to and overlies substrate 14. Bond coat layer 18 is typically formed from a metallic oxidation-resistant material that protects the underlying substrate 14 and enables the thermal barrier coating indicated generally as 22 to more tenaciously adhere to substrate 14. Suitable materials for bond coat layer 18 include MCrAlY alloy powders, where M represents a metal such as iron, nickel, platinum or cobalt, in particular, various metal aluminides such as nickel aluminide and platinum aluminide. This bond coat layer 18 can be applied, deposited or otherwise formed on substrate 10 by any of a variety of conventional techniques, such as physical vapor deposition (PVD), including electron beam physical vapor deposition (EBPVD), plasma spray, including air plasma spray (APS) and vacuum plasma spray (VPS), or other thermal spray deposition methods such as high velocity oxy-fuel (HVCF) spray, detonation, or wire spray, chemical vapor deposition (CVD), or combinations of such techniques, such as, for example, a combination of plasma spray and CVD techniques. Typically, a plasma spray technique, such as that used for the thermal barrier coating 22, can be employed to deposit bond coat layer 18. Usually, the deposited bond coat layer 18 has a thickness in the range of from about 1 to about 19.5 mils (from about 25 to about 500 microns). For bond coat layers 18 deposited by PVD techniques such as EBPVD, the thickness is more typically in the range of from about 1 about 3 mils (from about 25 to about 75 microns). For bond coat layers deposited by plasma spray techniques such as APS, the thickness is more typically, in the range of from about 3 to about 15 mils (from about 75 to about 385 microns).

As shown in the FIGURE, the thermal banier coating (TBC) 22 is adjacent to and overlies bond coat layer 18. The thickness of TBC 22 is typically in the range of from about 1 to about 100 mils (from about 25 to about 2564 microns) and will depend upon a variety of factors, including the article 10 that is involved. For example, for turbine shrouds, TBC 22 is typically thicker and is usually in the range of from about 30 to about 70 mils (from about 762 to about 1778 microns), more typically from about 40 to about 60 mils (from about 1016 to about 1524 microns). By contrast, in the case of turbine blades, TBC 22 is typically thinner and is usually in the range of from about 1 to about 30 mils (from about 25 to about 762 microns), more typically from about 3 to about 20 mils (from about 76 to about 508 microns).

As shown in the FIGURE, TBC 22 comprises an inner layer 26 that is nearest to substrate 14, and is adjacent to and overlies bond coat layer 18. This inner layer 26 comprises a ceramic thermal barrier coating material in an amount up to 100%. Typically, inner layer 26 comprises from about 95 to 100% ceramic thermal barrier coating material, and more typically from about 98 to 100% ceramic thermal barrier coating material. The composition of inner layer 26 in terms of the type of ceramic thermal barrier coating materials will depend upon a variety of factors, including the composition of the adjacent bond coat layer 18, the coefficient of thermal expansion (CTE) characteristics desired for TBC 22, the thermal barrier properties desired for TBC 22, and like factors well known to those skilled in the art. Inner layer 26 will normally comprise most of the thickness of TBC 22. Typically, inner layer 26 will comprise from about 95 to about 99%, more typically from about 97 to about 99%, of the thickness of TBC 22.

TBC 22 further comprises a thermally glazed outer layer indicated generally as 30 that is adjacent to and overlies inner layer 26 and has an exposed surface 34. This thermally glazed outer layer 30 of TBC 22 typically forms a hermetic, glassy layer that reduces the build up of these CMAS deposits on the coating, as well as preventing these CMAS deposits from infiltrating the porous surface structure of the inner layer 26 of TBC 22. This outer layer 30 comprises thermally glazeable coating materials in an amount up to 100% and sufficient to provide a thermally glazed outer layer 30 to protect TBC 22 at least partially against environmental contaminants that become deposited on the exposed surface 34 of outer layer 30. Typically, outer layer 30 comprises from about 95 to 100%, more typically from about 98 to 100%, thermally glazeable coating materials. The composition of outer layer 30 in terms of the type of thermally glazed coating material used will depend upon a variety of factors, including the composition of the adjacent inner layer 22, the CTE characteristics desired for TBC 22, the environmental contaminant protective properties desired, and like factors well know to those skilled in the art.

The thickness to outer layer 30 should be such to provide protection or mitigation against the adverse effects of environmental contaminant compositions, in particular CMAS, without unduly affecting the mechanical properties of TBC 22, including strain tolerance, modulus and thermal conductivity. In this regard, the thermally glazed outer layer 30 should relatively thin and have a thickness up to about 0.4 mils (10 microns). Typically, the thickness of TBC 22 is in the range of from about 0.04 to about 0.4 mils (from about 1 to about 10 microns), more typically from 0.1 to about 0.4 mils (from about 3 to about 10 microns).

The composition and thickness of the bond coat layer 18, and the inner layer 26 and outer layer 30 of TBC 22, are typically adjusted to provide appropriate CTEs to minimize thermal stresses between the various layers and the substrate 14 so that the various layers are less prone to separate from substrate 14 or each other. In general, the CTEs of the respective layers typically increase in the direction of outer layer 30 to bond coat layer 18, i.e., outer layer 30 has the lowest CTE, while bond coat layer 18 has the highest CTE.

Referring to the FIGURE, the inner layer 26 TBC 22 can be applied, deposited or otherwise formed on bond coat layer 18 by any of a variety of conventional techniques, such as physical vapor deposition (PVD), including electron beam physical vapor deposition (EBPVD), plasma spray, including air plasma spray (APS) and vacuum plasma spray (VPS), or other thermal spray deposition methods such as high velocity oxy-fuel (HVOF) spray, detonation, or wire spray, chemical vapor deposition (CVD), or combinations of plasma spray and CVD techniques. The particular technique used for applying, depositing or otherwise forming inner layer 26 will typically depend on the composition of inner layer 26, its thickness and especially the physical structure desired for TBC. For example, PVD techniques tend to be useful in forming an inner layer 26 having a porous strain-tolerant columnar structure with grooves, crevices or channels. By contrast, plasma spray techniques (e.g., APS) tend to create a sponge-like porous structure of open pores in inner layer 26. Typically, the inner layer 26 of TBCs 22 is formed by plasma spray techniques in the method of the present invention.

Various types of plasma-spray techniques well known to those skilled in the art can be utilized to apply the thermal barrier coating materials in forming the inner layer 26 of TBCs 22 of the present invention. See, for example, Kirk-Othmer Encyclopedia of Chemical Technology, 3rd Ed., Vol. 15, page 255, and references noted therein, as well as U.S. Pat. No. 5,332,598 (Kawasaki et al), issued Jul. 26, 1994; U.S. Pat. No. 5,047,612 (Savkar et al) issued Sep. 10, 1991; and U.S. Pat. No. 4,741,286 (Itoh et al), issued May 3, 1998 (herein incorporated by reference) which are instructive in regard to various aspects of plasma spraying suitable for use herein. In general, typical plasma spray techniques involve the formation of a high-temperature plasma, which produces a thermal plume. The thermal barrier coating materials, e.g., ceramic powders, are fed into the plume, and the high-velocity plume is directed toward the bond coat layer 18. Various details of such plasma spray coating techniques will be well-known to those skilled in the art, including various relevant steps and process parameters such as cleaning of the bond coat surface 18 prior to deposition; grit blasting to remove oxides and roughen the surface substrate temperatures, plasma spray parameters such as spray distances (gun-to-substrate), selection of the number of spray-passes, powder feed rates, particle velocity, torch power, plasma gas selection, oxidation control to adjust oxide stoichiometry, angle-of-deposition, post-treatment of the applied coating; and the like. Torch power can vary in the range of about 10 kilowatts to about 200 kilowatts, and in preferred embodiments, ranges from about 40 kilowatts to about 60 kilowatts. The velocity of the thermal barrier coating material particles flowing into the plasma plume (or plasma "jet") is another parameter which is usually controlled very closely.

Suitable plasma spray systems are described in, for example, U.S. Pat. No. 5,047,612 (Savkar et al) issued Sep. 10, 1991, which is incorporated by reference. Briefly, a typical plasma spray system includes a plasma gun anode which has a nozzle pointed in the direction of the deposit-surface of the substrate being coated. The plasma gun is often controlled automatically, e.g., by a robotic mechanism, which is capable of moving the gun in various patterns across the substrate surface. The plasma plume extends in an axial direction between the exit of the plasma gun anode and the substrate surface. Some sort of powder injection means is disposed at a predetermined, desired axial location between the anode and the substrate surface. In some embodiments of such systems, the powder injection means is spaced apart in a radial sense from the plasma plume region, and an injector tube for the powder material is situated in a position so that it can direct the powder into the plasma plume at a desired angle. The powder particles, entrained in a carrier gas, are propelled through the injector and into the plasma plume. The particles are then heated in the plasma and propelled toward the substrate. The particles melt, impact on the substrate, and quickly cool to form the thermal barrier coating.

In forming the TBCs 22 of the present invention, the inner layer 26 is initially formed on bond coat layer 18, followed by outer layer 30. In forming the TBCs 22 of the present invention, inner layer 26 is initially formed on bond coat layer 18 typically by depositing the ceramic thermal barrier coating material. The thermally glazeable coating material is then deposited on inner layer 26 by any of the techniques previously described for forming inner layer 26. This deposited thermally glazeable coating material is then thermally melted and then subsequently cooled (or allowed to cool) to form the thermally glazed outer layer 30 having exposed surface 34. Any method of thermally melting this thermally glazeable coating material to form a relatively thin thermally glazed outer layer 30 is suitable in the method of the present invention. For example, the thermally glazed outer layer 30 can be formed by electron beam melting or laser beam melting. Suitable methods for laser beam melting include those disclosed in U.S. Pat. No. 5,484,980 (Pratt et al), issued Jan. 16, 1996, which is incorporated by reference. In laser beam melting, a laser beam having a substantially circular beam footprint or spot is generated and then the generated beam is moved relative to the deposited thermally glazeable coating material (or the thermally glazeable coating material is moved relative to the generated beam) until the desired thermally glazed outer layer 30 is formed.

If desired, the particular ratio and/or amount of the ceramic thermal barrier coating material and thermally glazeable coating material can be varied as it is deposited onto bond coat layer 18 to form the respective inner layer 26 and outer layer 30 of TBC 22 to provide compositions and CTEs that vary through the thickness of TBC 22, as well as to provide a convenient method for forming respective inner layer 26, followed by outer layer 30. Indeed, the various layers of TBC 22 shown in the FIGURE can be formed conveniently by adjusting the ratio and/or amount of the ceramic thermal barrier coating material and thermally glazeable coating material as it is progressively and sequentially deposited.

The method of the present invention is particularly useful in providing protection or mitigation against the adverse effects of such environmental contaminate compositions for TBCs used with metal substrates of newly manufactured articles. However, the method of the present invention is also useful in providing such protection or mitigation against the adverse effects of such environmental contaminate compositions for refurbished worn or damaged TBCs, or in providing TBCs having such protection or mitigation for articles that did not originally have a TBC.

While specific embodiments of the present invention have been described, it will be apparent to those skilled in the art that various modifications thereto can be made without departing from the spirit and scope of the present invention as defined in the appended claims.

What is claimed is:

1. A method for preparing a thermal barrier coating for an underlying metal substrate, the method comprising the steps of:

1. forming an inner layer overlaying the metal substrate, the inner layer comprising a ceramic thermal barrier coating material having a melting point of at least about 2000° F.
2. depositing on the inner layer a thermally glazable coating material having a melting point of at least about 2000° F.; and
3. thermally melting by laser beam the deposited thermally glazeable coating material so as to form a thermally laser glazed outer layer adjacent to and overlaying the inner layer and having exposed surface, the thermally glazed outer layer having a thickness up to about 0.4 mils and sufficient to at least partially protect the thermal barrier coating against environmental contaminants that become deposited on the exposed surface.

2. The method of claim 1 wherein a bond coat layer is adjacent to and overlies the metal substrate and wherein the inner layer is formed on the bond coat layer.

3. The method of claim 2 wherein step (2) comprises depositing on the inner layer a mixture of from about 50 to about 95% of a chemically-stabilized zirconia, and from about 5 to about 50% alumina.

4. The method of claim 2 wherein step (2) comprises depositing on the inner layer a mixture of from about 80 to about 90% of a yttria-stabilized zirconia, and from about 10 to about 20% alumina.

5. A thermal barrier coating for an underlying metal substrate, which comprises:

a. an inner layer nearest to and overlaying the metal substrate and comprising from about 95 to 100% of a zirconia; and b. a thermally glazed outer layer adjacent to and overlaying the inner layer and having an exposed surface, the outer layer having a thickness up to about 0.4 mils and sufficient to at least partially protect the thermal barrier coating against environmental contaminants that become deposited on the exposed surface, the outer layer comprising from about 95 to 100% of a thermally glazeable mixture comprising from about 50 to about 95% chemically-stabilized zirconia, and from about 5 to about 50% alumina.

6. The coating of claim 5 which has a thickness of from about 1 to about 100 mils and wherein the outer layer has a thickness in the range of from 0.04 to about 0.4 mils.

7. The coating of claim 6 wherein the outer layer has a thickness in the range of from about 0.1 to about 0.4 mils.

8. The coating of claim 5 wherein the outer layer is thermally laser glazed.

9. The coating of claim 5 wherein the inner layer comprises from about 98 to 100% of a yttria-stabilized zirconia and wherein the outer layer comprises from about 98 to 100% of mixture of from about 80 to about 90% a yttria-stabilized zirconia, and from about 10 to about 20% alumina.

10. A thermally protected article, which comprises:

1. a metal substrate; and
2. a bond coat layer adjacent to and overlaying the metal substrate;
3. a thermal barrier coating having a thickness of from about 1 to about 100 mils and comprising:
   a. an inner layer adjacent to and overlaying the bond coat layer and comprising from about 95 to 100% zirconia; and
   b. a thermally laser glazed outer layer adjacent to and overlaying the inner layer and having an exposed surface, a thickness of from about 0.1 to about 0.4 mils, and comprising from about 95 to 100% of mixture of from about 50 to about 95% of a chemically-stabilized zirconia, and from about 5 to about 50% alumina.

11.The article of claim 10 wherein the inner layer comprises from about 98 to 100% of a yttria-stabilized zirconia and wherein the outer layer comprises from about 98 to 100% of mixture of from about 80 to about 90% of a yttria-stabilized zirconia, and from about 10 to about 20% alumina.

12. The article of claim 10 which is a turbine engine component.

13. The component of claim 12 which is a turbine shroud and wherein the thermal barrier coating has a thickness of from about 30 to about 70 mils.

14. The shroud of claim 13 wherein the thermal barrier coating has a thickness of from about 40 to about 60 mils.

* * * * *

UNITED STATES PATENT AND TRADEMARK OFFICE

CERTIFICATE OF CORRECTION

PATENT NO. : 6,933,061 B2
DATED : August 23, 2005
INVENTOR(S) : Nagaraj et al.

It is certified that error appears in the above-identified patent and that said Letters Patent is hereby corrected as shown below:

Column 1,
Line 53, the text "75 to about 1795" should be corrected to -- 76 to about 1778 --.

Column 6,
Line 37, the number "500" should be corrected to -- 495 --.
Line 40, the number "75" should be corrected to -- 76 --.
Line 43, the text "75 to about 385" should be corrected to -- 76 to about 381 --.
Line 48, the number "2564" should be corrected to -- 2540 --.

Column 9,
Line 53, the text "glazable" should be corrected to -- glazeable --.
Line 59, the text "having exposed" should be corrected to -- having an exposed --.

Column 10,
Line 34, after the words "to about 90%" and before the words "a yttria-stabilized" the word -- of -- should be inserted.

Signed and Sealed this

Eighth Day of November, 2005

JON W. DUDAS
*Director of the United States Patent and Trademark Office*